US007647984B2

(12) United States Patent
Moyna

(10) Patent No.: US 7,647,984 B2
(45) Date of Patent: Jan. 19, 2010

(54) PUSH BLOCK, SCRAPING DEVICE AND METHOD FOR COLLECTING A MATERIAL

(75) Inventor: John P. Moyna, Elkader, IA (US)

(73) Assignee: Caterpillar Inc., Peoria, IL (US)

( * ) Notice: Subject to any disclaimer, the term of this patent is extended or adjusted under 35 U.S.C. 154(b) by 96 days.

(21) Appl. No.: 11/977,367

(22) Filed: Oct. 24, 2007

(65) Prior Publication Data

US 2009/0108565 A1 Apr. 30, 2009

(51) Int. Cl.
*E02F 3/76* (2006.01)

(52) U.S. Cl. ..... 172/799.5; 37/435

(58) Field of Classification Search ..... 37/411, 37/415, 416, 424–430, 445, 903, 435, 266–284; 172/199, 200, 197, 815, 777–799.5
See application file for complete search history.

(56) References Cited

U.S. PATENT DOCUMENTS 2,312,471 A * 3/1943 Low ..... 404/121
3,099,191 A * 7/1963 Averette ..... 404/121
3,358,569 A * 12/1967 Averette ..... 404/121
3,962,804 A * 6/1976 Hyler ..... 37/425
4,723,870 A * 2/1988 Martinez ..... 404/121
4,823,421 A * 4/1989 Kleynjans et al. ..... 14/71.3
6,910,289 B2 6/2005 Moyna
7,117,953 B2 10/2006 Moyna
7,356,949 B2 4/2008 Moyna
7,367,408 B2 5/2008 Moyna

OTHER PUBLICATIONS

Copending U.S. Appl. No. 12/071,457, filed Feb. 21, 2008, named inventor: Moyna.
Copending U.S. Appl. No. 11/726,462, filed Mar. 21, 2007, named inventor: Moyna.
Copending U.S. Appl. No. 11/906,472, filed Oct. 2, 2007, named inventor: Moyna.

* cited by examiner

*Primary Examiner*—Robert E Pezzuto
(74) *Attorney, Agent, or Firm*—Finnegan, Henderson, Farabow, Garrett & Dunner

(57) ABSTRACT

A push block, a scraping device and a method for collecting a material are provided. The scraping device has a frame, a blade attached to the bottom of the frame, a tongue attached to a front end of the frame and a beam attached to a back end of the frame. Tires are connected to the beam. The scraping device has a front lift mechanism at the front end of the frame and/or a rear lift mechanism at the back end of the frame. The front lift mechanism has a front cylinder connected to the tongue and the front end of the frame. The rear lift mechanism has a rear cylinder attached to the back end of the frame. Movement of the front cylinder and the rear cylinder results in raising and/or lowering of the corresponding ends of the frame of the scraping device. The push block is pivotally connected to an arm and pivotally connected to a tire beam. The arm and the tire beam are pivotally connected to the back end of the frame. Connections between the push block, the arm, the tire beam and the back end of the frame form corners of a parallelogram shape. The parallelogram shape enables the push block to maintain a consistent ground clearance if the frame raises or lowers relative to the ground and/or to the tire beam.

20 Claims, 6 Drawing Sheets

PUSH BLOCK, SCRAPING DEVICE AND METHOD FOR COLLECTING A MATERIAL

BACKGROUND OF THE INVENTION

The present invention generally relates to a push block, a scraping device and a method for collecting a material. The push block, the scraping device and the method for collecting a material may be attached to an earthmoving scraping device and may allow the push block to maintain a clearance from the ground. The push block, the scraping device and the method for collecting a material may have a bumper that transmits force to a frame of an attached scraping device. As a result, the push block, the scraping device and the method for collecting a material may provide a mechanism that allows a scraping device to receive force from contact by an additional vehicle despite variations in ground clearance of the scraping device.

Earthmoving generally involves breaking apart soil of a construction area. The soil may be used in the existing project and/or hauled to a remote site. Like other construction projects, highway construction often requires breaking apart the soil of the construction area. The soil must be broken apart and removed before paving of a roadway. An area must be pre-treated to create a surface that is suitable for paving. If the area to be paved has soil, the soil may be broken prior to compaction or other processes. The soil may also be collected and moved to a different location.

Highways allow goods to be transported and provide economic stimulus to areas through which cars, trucks and other vehicles travel. Given such importance, building roads and maintaining existing ones are undertaken by national governments and/or local municipalities.

Removal of earth materials is performed by several different machines. The use of specific machinery is determined by the type of project. Several factors to be considered are the type of material to be removed, the distance the material is to be transported and/or the plans for the use of the material. Choosing the machine factors significantly into the costs of the project. Using the wrong equipment for a project results in delays that lead to significant expenditure of labor and/or money. As a result, the process of removing earth materials may result in an economic burden to the cost of the project. Therefore, construction projects require use of the proper equipment as well as efficient and successful performance of the equipment.

Typically, earthmoving equipment, such as scrapers, may carry large volumes of materials. The scrapers may be towed or self-propelled. One such scraper has a frame shaped like a bowl and a lip that serves as a wall to prevent soil or other materials from leaving the frame. To aid in removal and containment of materials, the lip may be attached to a cylinder which raises or lowers the lip. A blade is attached near the bottom of the frame and below the lip. As the scraper is moved across an area of soil to be broken apart, the blade of the scraper may press into the area of the soil, and the soil may be collected within the frame. The lip may prevent the material from exiting the frame during transport of the frame to another area. After the frame is transported to a desired location, the collected material may be deposited by lowering the lip to provide an open area to allow removal of the material from the scraper.

Many different types of scrapers are known, such as pull-scrapers, motor scrapers, twin-engine scrapers, paddle wheel scrapers, and auger scrapers. Transportation of the loads of these scrapers has always been subject to delays because travel of construction machines travel along unpaved roads may form road irregularities. The road irregularities, such as sunken tracks or grooves in the road, may cause scrapers to get stuck in the channels. It may be difficult to remove the heavy, material-filled scrapers after the same becomes stuck. A stuck scraper may cause efficiency problems because the project is delayed, and construction ceases until the scraper is unloaded and freed. Further delay may be incurred because many models have rudimentary push block systems that impede efficient removal of a stuck scraper. The rudimentary push block systems have an altered height of the bumper as a result of the scraping device being in a hole or on a bump, and thus, a height of the push block may not allow the other vehicle to push upon the push block. Therefore, continued scraper operation determines productivity of the scraping device. A stuck scraper that is not freed from the road irregularity that impedes travel may slow down the progress of any project, may cease progress of the project and/or may increase the likelihood of cost overruns.

Additionally, the rudimentary push block systems are fixedly attached to the frame of the scraping device so that raising or lowering of the frame to adjust ground clearance of the device also raises or lowers the bumper. Raising or lowering of the bumper may preclude an additional vehicle from contacting the bumper to exert force upon the scraping device. Therefore, scraping that requires additional force is hindered by the height of the bumper preventing contact by the additional vehicle.

A need, therefore, exists for a push block, a scraping device and a method for collecting a material that allow earthmoving equipment to function in a reliable and/or efficient manner in collection and/or removal of materials.

SUMMARY OF THE INVENTION

The present invention generally relates to a push block, a scraping device and a method for collecting a material. More specifically, the present invention relates to a push block, a scraping device and a method for collecting a material extending rearwardly from a scraping device. The push block, the scraping device and the method for collecting a material may have a bumper for transmitting force to the scraping device. The bumper may have a convex surface facing away from the scraping device that transmits force exerted on the push block by another vehicle to the scraping device. The push block may be pivotally attached to an upper arm that may be connected to a back end of a frame of the scraping device. The push block may be pivotally attached to a tire beam that may be connected to the back end of the frame of the scraping device. The tire beam and/or the upper arm may be pivotally connected to the back end of the frame of the scraping device. The tire beam may have one or more axles that connect one or more wheels to the tire beam. The wheels may engage a surface to provide movement for the attached scraping device. The bumper of the push block may maintain a consistent ground clearance for the push block despite changes in a position of the scraping device and changes in ground clearance of the frame of the scraping device.

The push block may be attached to a scraping device containing a frame having a first end and a second end. The scraping device may have a front wall and a back wall attached to the frame that may create an open-air, bowl-shaped interior. The scraping device may also have a lip pivotally attached to the first end. An ejecting mechanism may be provided to remove collected materials. The scraper may have a blade attached to the bottom of the frame. As the scraper moves across the ground, the blade may chop the surface and/or may push the materials into the frame. In addition, the scraper may have a rear lift mechanism and/or a front lift mechanism.

In an embodiment of the present invention a push block is provided. The push block has an arm having a length defined by a first end and a second end wherein the second end in a position opposite to the first end; a tire beam having a length defined by a first end beam and a second end wherein the second end is in a position opposite to the first end of the tire beam; and a bumper connected to the arm and the tire beam wherein the bumper has an inner surface and an outer surface wherein the outer surface is in a position opposite to the inner surface. The push block has a first pivot on the arm wherein the first pivot on the arm connects the bumper to the second end of the arm; a second pivot on the arm wherein the second pivot on the arm is positioned at the first end of the arm; and a first pivot on the tire beam wherein the first pivot on the tire beam connects the bumper to the second end of the tire beam wherein the first pivot on the tire beam is positioned at a distance from the first pivot on the arm. The push block has a second pivot on the tire beam wherein the second pivot on the tire beam is positioned at the first end of the tire beam wherein the second pivot on the tire beam is positioned at a distance from the second pivot on the arm wherein the distance of the second pivot on the tire beam from the second pivot on the arm is equal to the distance of the first pivot on the tire beam from the first pivot on the arm wherein the second pivot on the tire beam is a distance from the first pivot on the tire beam wherein the distance of the second pivot on the tire beam from the first pivot on the tire beam is equal to the length of the arm.

In an embodiment, the push block has a plurality of pins wherein the first pivot on the arm, the first pivot on the tire beam, the second pivot on the arm and the second pivot on the tire beam each have one of the plurality of pins.

In an embodiment, the push block has a support that connects the bumper to the first pivot of the arm and the first pivot of the tire beam wherein the support has an inner surface that is connected to the arm and the tire beam and an outer surface that is attached to the inner surface of the bumper wherein the outer surface is in a position opposite to the inner surface.

In an embodiment, the push block has an upper surface on the bumper and a lower surface on the bumper wherein the lower surface is in a position opposite to the upper surface wherein the upper surface and the lower surface are substantially parallel.

In an embodiment, the push block has a tire connected to the tire beam.

In an embodiment, the push block has a cylinder connected to the tire beam and to a cylinder pivot adjacent to the second pivot of the arm wherein movement of the cylinder moves the tire beam from a first position relative to the cylinder pivot to a second position relative to the cylinder pivot wherein the first position is a different position than the second position.

In another embodiment, a method for collecting a material from a surface is provided. The method for collecting a material comprises the steps of: providing a scraping device having a frame having walls defining an interior wherein the frame has a length defined between a front end and a back end wherein the back end is connected to a tire beam at a first lower pivot wherein the tire beam rotates relative to the back end of the frame wherein the back end of the frame is connected to an arm at a first upper pivot wherein the first upper pivot is positioned at a height above the first lower pivot wherein the arm is connected to a push block at a second upper pivot wherein the push block has a bumper wherein the second upper pivot is positioned at a distance from the first upper pivot wherein the push block transmits force from the bumper to the frame wherein the tire beam is connected to the push block at a second lower pivot wherein the second upper pivot is positioned at a height above the second lower pivot wherein the height of the first upper pivot above the first lower pivot is equal to the height of the second upper pivot above the second lower pivot wherein the second lower pivot is positioned at a distance from the first lower pivot wherein the distance of the second lower pivot from the first lower pivot is equal to the distance of the second upper pivot from the first upper pivot; contacting the push block with another vehicle; and moving the scraping device across the ground surface.

In an embodiment, a method for collecting a material is provided further comprising the step of: moving a cylinder attached to the tire beam and to the back end of the frame wherein moving the cylinder adjusts a distance of the back end from the tire beam.

In an embodiment, a method for collecting a material is provided further comprising the step of: moving a plate positioned in the interior from the back end to the front end to force the material from the frame.

In an embodiment a method for collecting a material is provided further comprising the step of: raising a lip connected to the front end of the frame and extending above the frame wherein the lip is raised to allow material to be pushed from the frame.

In an embodiment a method for collecting a material is provided further comprising the step of: moving the frame from a first position relative to the tire beam to a second position of the frame relative to the tire beam wherein the second position is a position different from the first position.

In an embodiment a method for collecting a material is provided further comprising the step of: moving the push block from a first position relative to the back end to a second position relative to the back end wherein the second position is a position different from the first position wherein a distance of the push block from the ground surface is the same in the first position and the second position.

In another embodiment, a scraping device for scraping an area of soil is provided. The scraping device has a frame having walls defining an interior and further having a length defined between a first end and a second end wherein the second end is in a position opposite to the first end. The scraping device has a tongue extending from the first end of the frame; and a tire beam connected to the second end of the frame at a first lower pivot wherein the frame is at a first vertical position relative to the tire beam. The scraping device has a push block connected to the tire beam at a second lower pivot wherein a first distance is defined by the first lower pivot and the second lower pivot wherein the push block has an outer surface wherein the outer surface is located in a position opposite to the first end of the frame; and connecting means attached to the second end of the frame at a first upper pivot wherein the connecting means is attached to the push block at a second upper pivot wherein a second distance is defined by the first upper pivot and the second upper pivot wherein the first distance is equal to the second distance wherein a third distance is defined by the first upper pivot and the first lower pivot wherein a fourth distance is defined by the second upper pivot and the second lower pivot wherein the third distance is equal to the fourth distance.

In an embodiment, the scraping device has a surface on the push block wherein the surface is convex relative to the push block and in a position opposite to the first end of the frame.

In an embodiment, the scraping device has pins that attach the connecting means to the first upper pivot and the second upper pivot.

In an embodiment, the scraping device has a support that connects the tire beam to the first lower pivot wherein rotation of the support relative to the back end of the frame moves the second end of the frame from a first distance from the tire beam to a second distance from the tire beam wherein the second distance is a distance different from the first distance.

In an embodiment, the scraping device has a cylinder connected to the second end of the frame and to the tire beam wherein movement of the cylinder adjusts a distance of the second end of the frame from the tire beam.

In an embodiment, the scraping device has a cylinder connected to the first end of the frame and to the tongue wherein the cylinder moves to adjust a distance of the first end of the frame from the tongue.

In an embodiment, the scraping device has an ejector plate positioned at the back end of the frame wherein moving the ejector plate in a direction toward the front end of the frame pushes material from the frame.

In an embodiment, the scraping device has a lip connected to the front end of the frame and extending above the frame wherein the lip is raised to allow material to be pushed from the frame.

It is, therefore, an advantage of the present invention to provide a push block, a scraping device and a method for collecting a material which may provide an earthmoving device with efficient travel over various topographies, including topographies that have irregularities in the ground surface.

Another advantage of the present invention is to provide a push block, a scraping device and a method for collecting a material which may reduce the risk of delays associated with damage to the machine and attached tires.

Another advantage of the present invention is to provide a push block, a scraping device and a method for collecting a material that maintains ground clearance for the push block during travel of an earthmoving device Another advantage of the present invention is to provide a push block, a scraping device and a method for collecting a material that prevents heightened areas in a road from interrupting travel of the device.

Another advantage of the present invention is to provide a push block, a scraping device and a method for collecting a material that allows force to be exerted upon the push block without altering the ground clearance of the push block.

Another advantage of the present invention is to provide a push block, a scraping device and a method for collecting a material that positions a push block at a height that allows a scraping device having impeded travel to be pushed away from a road irregularity.

Another advantage of the present invention is to provide a push block, a scraping device and a method for collecting a material that positions a push block at a height that allows a scraping device having impeded travel to be pushed away from a road irregularity.

Another advantage of the present invention is to provide a push block, a scraping device and a method for collecting a material that adjusts a ground clearance of the scraping device frame and/or maintains a height of the push block.

Another advantage of the present invention is to provide a push block, a scraping device and a method for collecting a material that allows a second vehicle to push a scraping device while the ground clearance of the scraping device may be altered.

Additional features and advantages of the present invention are described in, and will be apparent from, the detailed description of the presently preferred embodiments and from the drawings.

DETAILED DESCRIPTION OF THE PRESENTLY PREFERRED EMBODIMENTS

The present invention generally relates to a push block, a scraping device and a method for collecting a material. More specifically, the present invention relates to a push block, a scraping device and a method for collecting a material extending rearwardly from a scraping device. The push block, the scraping device and the method for collecting a material may have a bumper for transmitting force to a scraping device. The bumper may have a surface facing away from the vehicle that allows force to be exerted on the push block by contact with another vehicle. The push block may have a first upper pivot connected to an upper arm and/or may have a lower pivot connected to a tire beam. The tire beam and/or the upper arm may be pivotally connected to the frame of the scraping device. The tire beam may have one or more axles that connect one or more wheels to the tire beam. The wheels may engage a surface to provide movement for the attached scraping device. The bumper of the push block may maintain a consistent ground clearance despite changes in a position of the scraping device and/or clearance of the frame of the scraping device.

Figure 1:
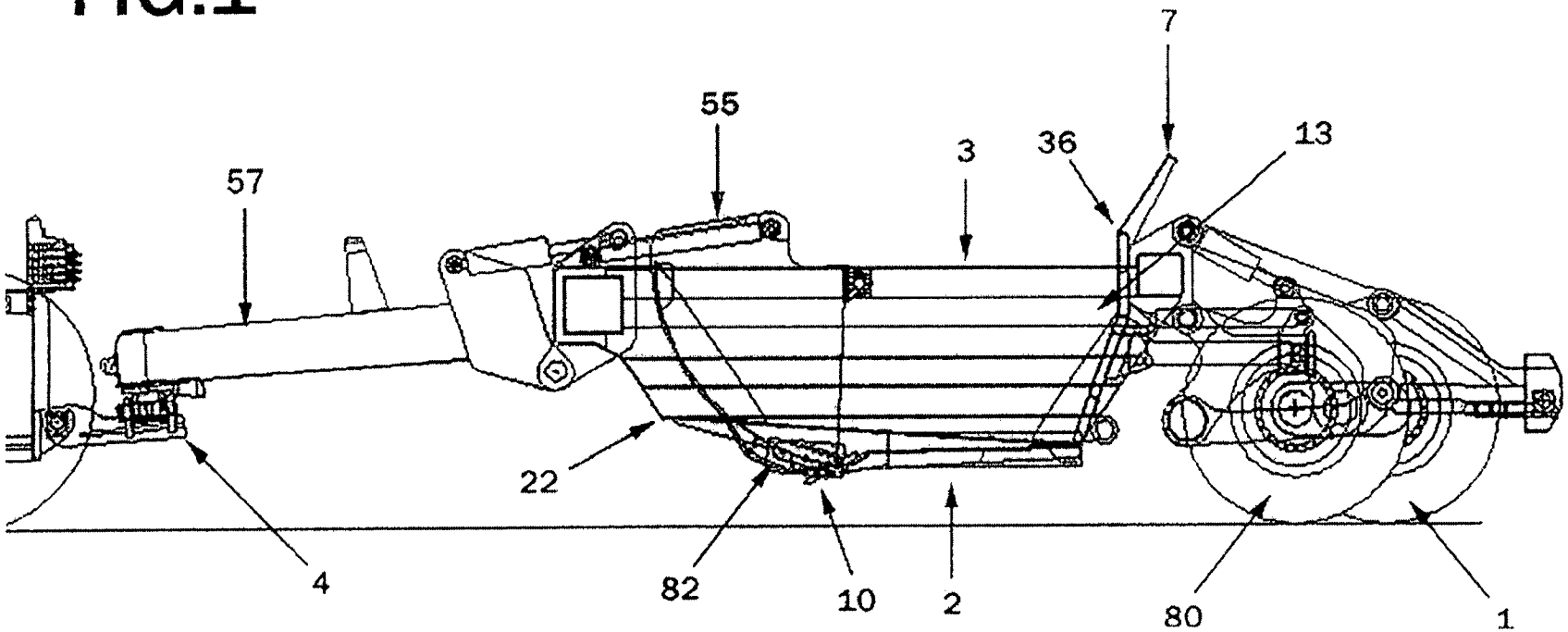
FIG. 1 illustrates a side view of the earth moving scraping device in an embodiment of the invention.

FIG. 1 generally illustrates a scraping device 1 in an embodiment of the present invention. The scraping device 1 may have a bowl-shaped frame 2 having walls 13 defining an interior 3 into which materials may be collected and/or transported. A blade 10 may be attached to the frame 2 at a front end 22 of the frame 2. Adjacent to the blade 10 may be a router bit 82 which may assist in cutting into materials and may prevent the materials from causing wear to the scraping device 1.

Figure 2:
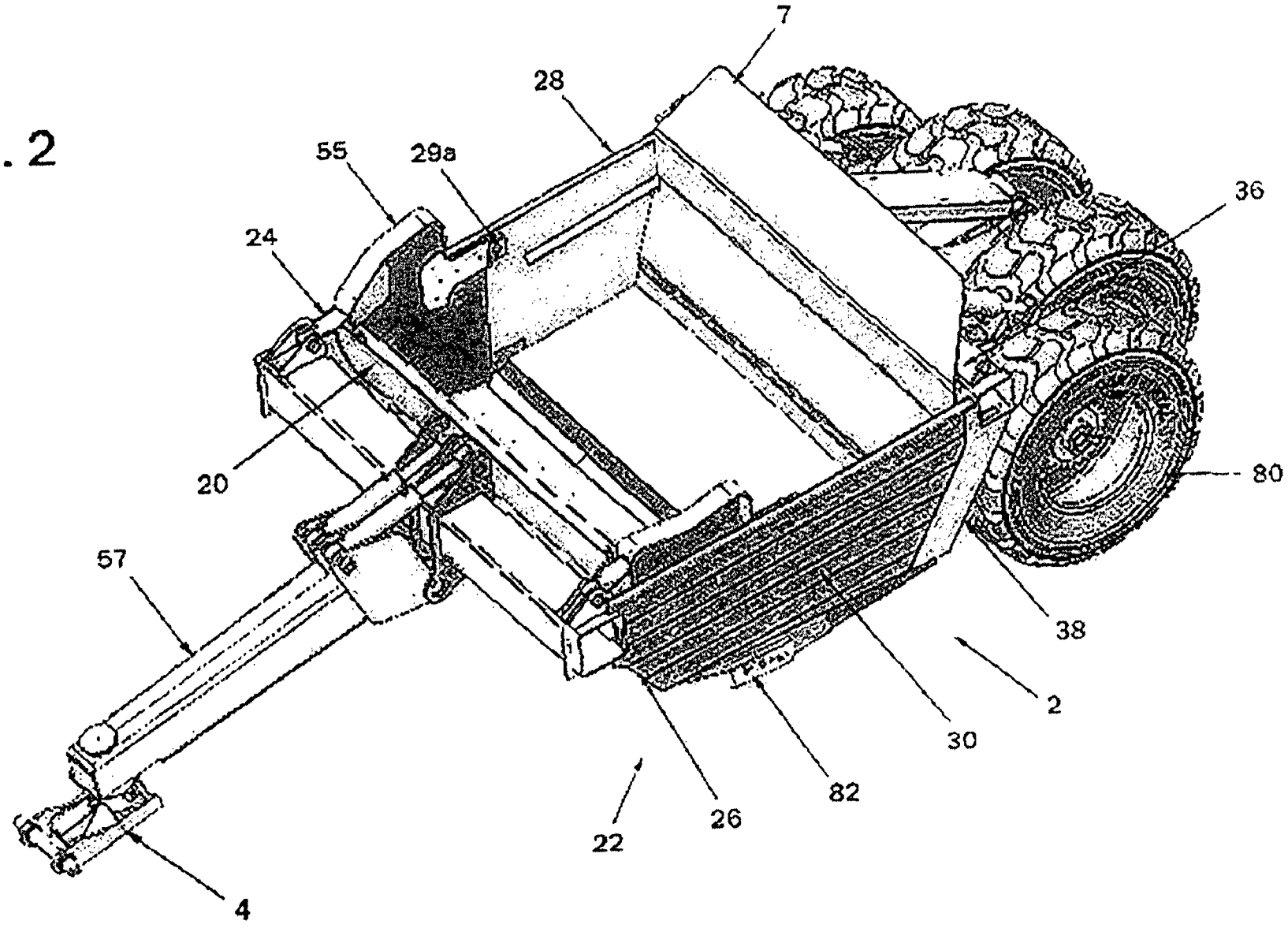
FIG. 2 illustrates a perspective view of the earth moving scraping device in an embodiment of the invention.

FIG. 2 generally illustrates an elevated view of the frame 2. A lip 20 may be attached to the frame 2 at the front end 22 of the frame 2. The lip 20 may be sized wherein a height 21 of the lip 20 may be substantially the same or may be greater than a height 23 of the frame 2. A width 25 of the lip 20 may be substantially the same or may be less than a width 27 of the frame 2. The size of the lip 20 may prevent materials within the frame 2 from falling from an opening (not shown) at the front end 22 of the frame 2.

The lip 20 may be pivotally connected to the frame 2 at points 29*a*, 29*b* on sides 28, 30, respectively, of the lip 20. Cylinders 24, 26 may be attached to the lip 20 on the sides 28, 30 at points 63*a*, 63*b*. The cylinders 24, 26 may be partially shielded by flaps 55 that may be attached to the lip 20. In an embodiment, the lip 20 may be pivotally attached to the sides 28, 30 of the frame 2 by, for example, pins (not shown) inserted at points 29*a*, 29*b*. The cylinders may be attached to the frame 2 at the front end 22 of the frame 2. The cylinders 24, 26 may be hydraulic and may use a hydraulic fluid to effect movement of the cylinders 24, 26.

An ejector plate 36 may be positioned at a back end 38 of the frame 2. The ejector plate 36 may be sized wherein a height 61 of the ejector plate 36 may be substantially the same or may be greater than the height 23 of the frame 2. A width 65 of the ejector plate 36 may be substantially the same or may be less than the width 27 of the frame 2. In addition, a guard 7 may be attached to, or integrally formed with, the ejector plate 36. The guard 7 may be a planar wall and may extend vertically from the ejector plate 36.

The frame 2 may be connected to a hitch 4 by a tongue 57. The hitch 4 may allow the scraping device 1 to be connected to a tractor (not shown) or other vehicle. The tractor may pull the scraping device 1 along an area, such as, for example, an area of grass or soil to be broken and/or collected. Wheels 80 may be associated with the scraping device 1 to enable the scraping device 1 to be transported.

The scraping device 1 may be connected to a tractor (not shown) and may be pulled across an area to collect materials within the frame 2. The cylinders 24, 26 may be moved to raise the lip 20. The opening may then be exposed at the front end 22 of the frame 2, and materials may be collected through the opening. As the scraping device 1 is moved across the area, the blade 10 and/or the router bit 82 may slice into the area and may cause materials to be removed from the area. The removed materials may be collected at the back end 38 of the frame 2. After the materials have been collected, the cylinders 24, 26 may be moved to lower the lip 20 and may prevent the collected materials from slipping from the frame 2 through the opening at the end 22 of the frame 2. The ejector plate 36 may move toward the lip 20 for removing the materials from the scraping device 2. As the ejector plate 36 moves toward the lip 20, the materials within the frame 2 may be pushed by the ejector plate 36 through the opening within the frame 2.

A front lift mechanism 60 may be associated with the front end 22 of the frame 2. The front lift mechanism 60 may have two front cylinders 12*a*, 12*b*. Alternatively, the front lift mechanism 60 may have one front cylinder. The front cylinders 12*a*, 12*b* may be positioned above the tongue 57. The front cylinders 12*a*, 12*b* may be pivotally connected to first plates 14*a* at top ends 15*a* of the first plates 14*a*. The first plates 14*a* may be fixedly connected to the back end 59 of the tongue 57 so that movement of the first plates 14*a* may cause corresponding movement of the back end 59 of the tongue 57. The second plates 14*b* may be fixedly connected to the front end 22 of the frame 2 so that movement of the second plates 14*b* may cause corresponding movement of the front end 22 of the frame 2. In a preferred embodiment, the second plates 14*b* may be fixedly attached to a front tube 91 on the front end 22 of the frame 2. The front cylinders 12*a*, 12*b* may be connected to the second plates 14*b* at top ends 15*b* of the second plates 14*b*. Accordingly, the first plates 14*a*, second plates 14*b* and front cylinders 12*a*, 12*b* may provide a triangular shape.

Furthermore, the first plates 14*a*, the second plates 14*b* and the front cylinders 12*a*, 12*b* may associate the tongue 57 with the front end 22 of the frame 2. Bottom ends 16*b* of the second plates 14*b* may be in a position opposite to the top ends 15*b* of the second plates 14*b*. Bottom ends 16*a* of the first plates 14*a* may be in a position opposite to that of the top ends 15*a* of the first plates 14*a*. The bottom ends 16*a* of the first plates 14*a* may be pivotally connected to the bottom ends 16*b* of the second plates 14*b*. The bottom ends 16*a* of the first plates 14*a* may be pivotally connected to the bottom ends 16*b* of the second plates 14*b* at a pivot 71 below the tongue 57. Therefore, pivotal association of the first plates 14*a* with the second plates 14*b* may allow the tongue 57 to be pivotally associated with the front end 22 of the frame 2.

Figure 3:
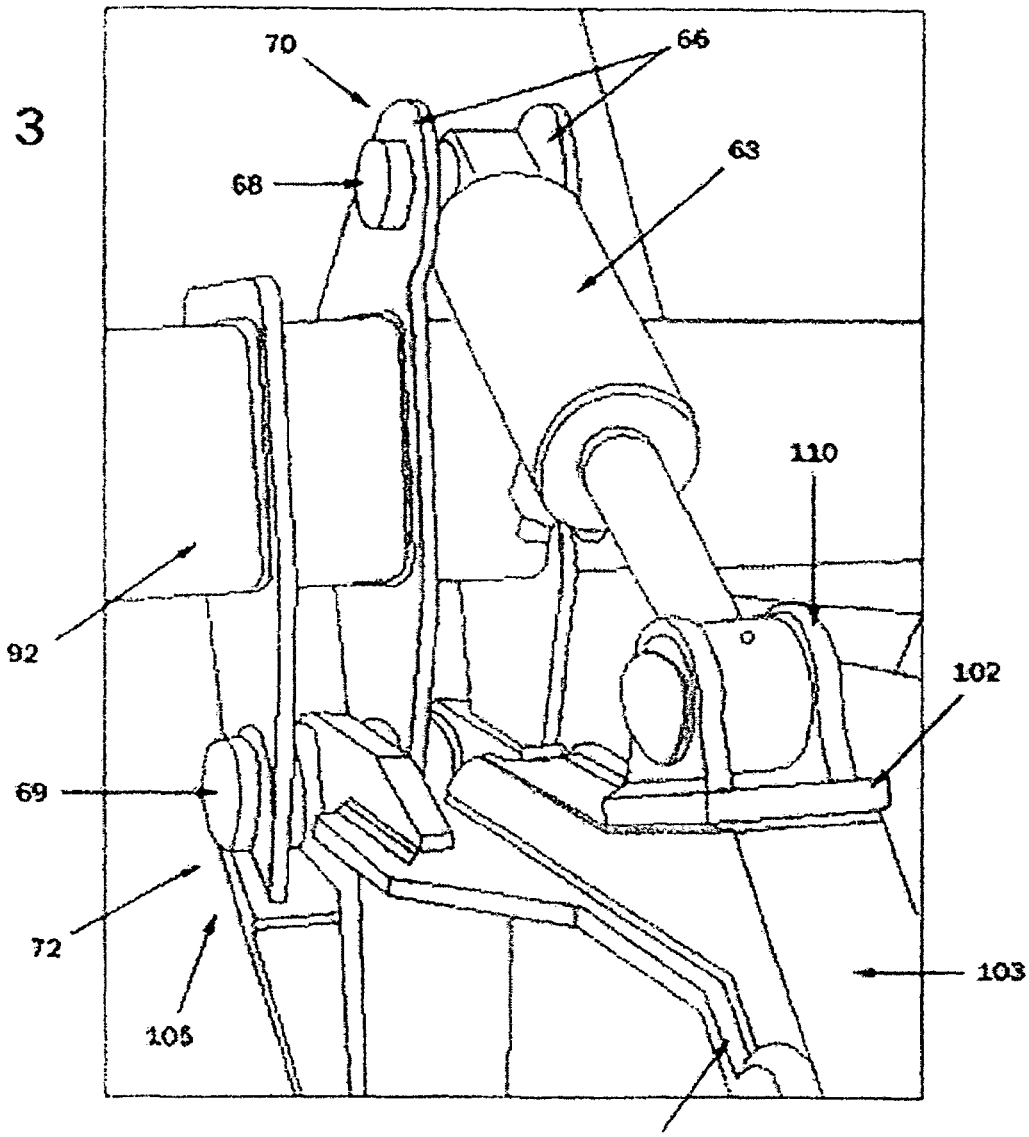
FIG. 3 illustrates a perspective view of the earth moving scraping device in an embodiment of the invention.

A rear lift mechanism 61 may be associated with the back end 38 of the frame 2. The rear lift mechanism 61 may have a rear cylinder 63. Alternatively, the rear lift mechanism 61 may have more than one rear cylinder. As generally shown in FIG. 3, the rear lift mechanism 61 may have third plates 66 attached to the back end 38 of the frame 2. The third plates 66 may be fixedly connected to the back end 38 of the frame 2 so that movement of the third plates 66 may cause corresponding movement of the back end 38 of the frame 2. In a preferred embodiment, the third plates 66 may be fixedly attached to a rear tube 92 on the back end 38 of the frame 2. The third plates 66 may have top ends 70 and/or bottom ends 72 in a position opposite to the top ends 70. The third plates 66 may have a top pivot 68 at the top ends 70 and/or a bottom pivot 69 at the bottom ends 72. The rear lift mechanism 61 may have a beam 102 with at least one tire 80 attached to the beam 102. The beam 102 may have a front end 105 pivotally attached to the bottom pivot 69 of the third plates 66. The rear cylinder 63 may be pivotally attached to the top pivot 68 of the third plates and/or may be pivotally attached to the beam 102. Accordingly, the third plates 66, the beam 102 and the rear cylinder 63 may provide a triangular shape. In a preferred embodiment of the present invention, the rear cylinder 63 may be attached to a top surface 103 of the beam 102 by a third rear pivot 110.

The front end 22 and/or the back end 38 may be raised to increase clearance underneath the frame 2 of the scraping device 1. The front end 22 and/or the back end 38 may be lowered to decrease clearance underneath the frame 2 of the scraping device 1.

Figure 4:
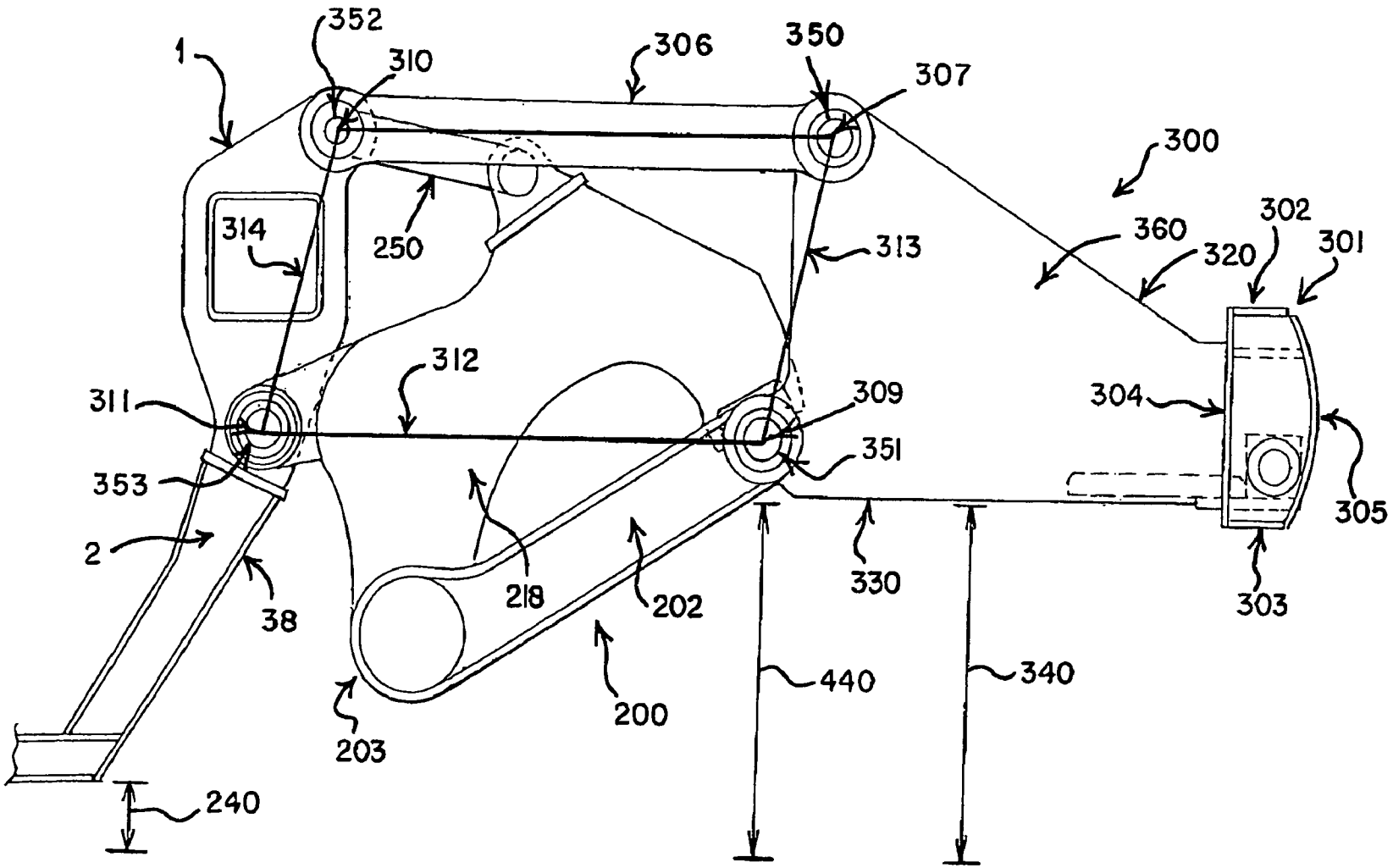
FIG. 4 illustrates a side view of the push block attached to the earth moving scraping device in an embodiment of the invention.
Figure 5:
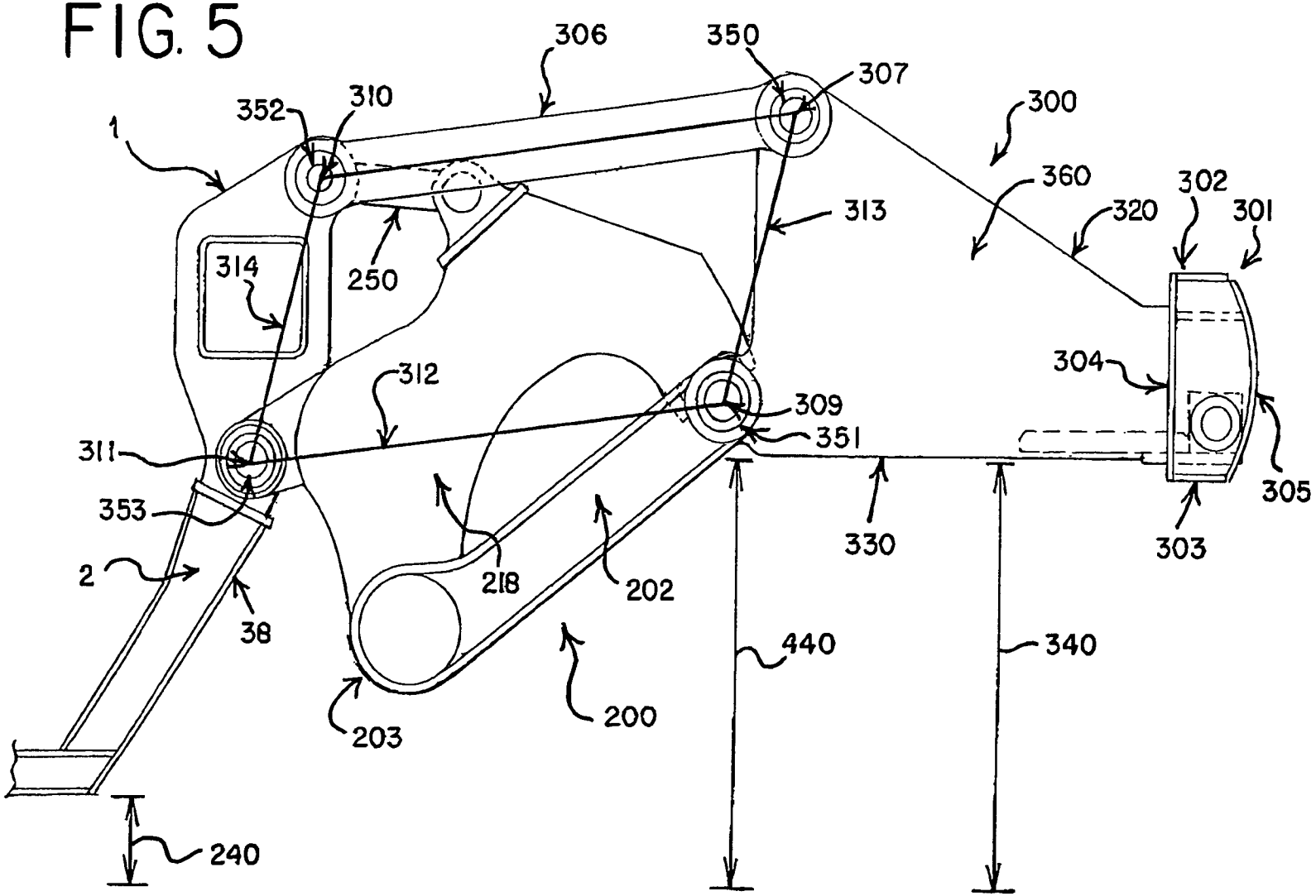
FIG. 5 illustrates a side view of the push block attached to the earth moving scraping device in an embodiment of the invention.
Figure 6:
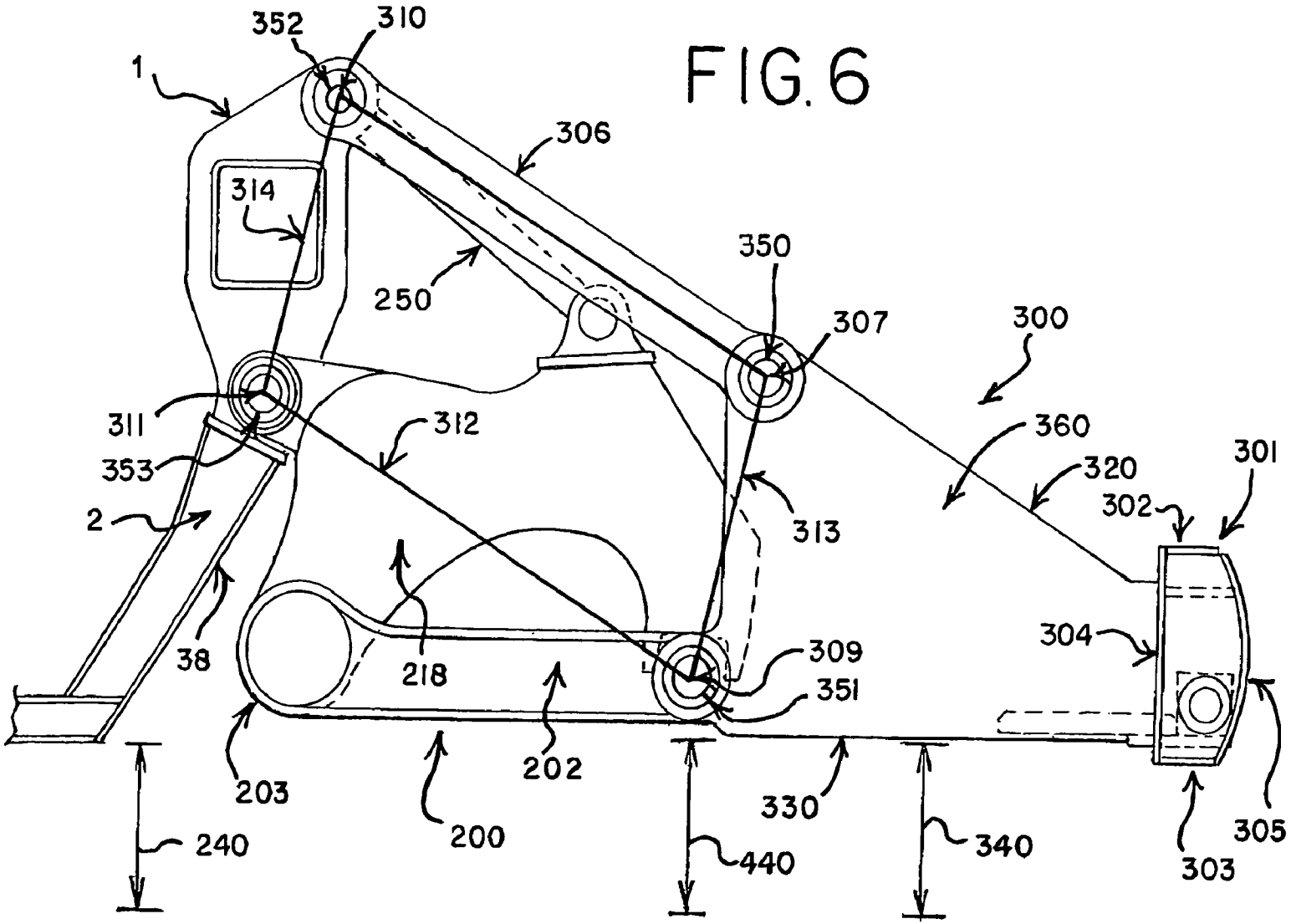
FIG. 6 illustrates a side view of the push block attached to the earth moving scraping device in an embodiment of the invention.

As generally shown in FIGS. 4-6, a tire beam system 200 may have a central beam 202 with a first end 203 and a second end 204. The central beam 202 may be connected to the frame 2 of the scraping device 1 to transversely support a load of the scraping device 1. A first axle (not shown) may attach to the first end 203 of the central beam 202 and/or a second axle (not shown) may attach to the second end 204 of the central beam 202. Multiple axles may be attached to the central beam 202 and may allow multiple tires (not shown) to connect to the central beam 202. A tire beam arm 250 may connect a support 218 to the tire beam pivot 215. The support 218 may be connected to the central beam 202.

As seen in FIGS. 4-6, a push block 300 may be connected to the back end 38 of the frame 2 of the scraping device 1. The push block 300 may have a generally rectangular bumper 301. The bumper 301 may have a flat upper surface 302. The bumper 301 may have a flat lower surface 303 that may be in a position opposite to the flat upper surface 302 and/or may be parallel to the flat upper surface 302. An inner vertical surface 304 may be adjacent to the frame 2 of the scraping device 1 and/or may be perpendicular to the upper surface 302 and/or the lower surface 303. An outer vertical surface 305 may be in a position opposite to the inner vertical surface 304. The push block 300 may have a support 360 that connects the bumper 301 to the back end 38 of the frame 2. The support 360 may have an upper block surface 320 and/or may have a lower block surface 330. The lower surface 330 of the bumper 301 may have a distance 340 from the ground that may provide ground clearance for the push block 300. The frame 2 of the scraping device 1 may have a distance 240 from the ground.

The outer vertical surface 305 may be convex relative to the bumper 301 so that the convex outer vertical surface 305 provides additional surface area relative to a bumper 301 having a flat outer vertical surface 305. The additional surface area of the outer vertical surface 305 may increase the force transmitted to the scraping device 1 by contact of an additional vehicle (not shown) with the push block 300. The additional surface area provided by the convex shape of the outer vertical surface 305 may allow contact with the push block 300 from various angles to transmit force to the scraping device 1. Force generated by the scraping device 1 and/or the force transmitted by the contact with the additional vehicle may be transmitted to the blade 10.

The push block 300 may be pivotally attached to an upper arm 306 at a first upper pivot 307 and/or may be pivotally attached to the central beam 202 at a first lower pivot 309. The first lower pivot 309 may be a distance 440 from the ground. The push block 300 may be in a level orientation wherein the distance 440 of the first lower pivot 309 from the ground may be approximately equal to the distance 340 of the lower surface 330 of the bumper 301 from the ground. Pivotal attachment at the first upper pivot 307 may be provided by a first pin 350 inserted between the upper arm 306 and the push block 300. Pivotal attachment at the first lower pivot 309 may be provided by a second pin 351 inserted between the central beam 202 and the push block 300.

The upper arm 306 may be pivotally attached to the back end 39 of the frame 2 of the scraping device 1 at a second upper pivot 310. Pivotal attachment at the second upper pivot 310 may be provided by a third pin 352 inserted between the upper arm 306 and the back end 38 of the frame 2 of the scraping device 1. The support 218 may connect the central beam 202 to a second lower pivot 311 on the back end 38 of the frame 2 of the scraping device 1. Pivotal attachment at the second lower pivot 311 may be provided by a fourth pin 353 inserted between the support 218 and the back end 38 of the frame 2 of the scraping device 1.

The first lower pivot 309 and the second lower pivot 311 may form a line 312 that may be parallel to the upper arm 306. A length of the upper arm 306 may be equal to a length of the line 312 between the first lower pivot 309 and the second lower pivot 311. The first lower pivot 309 and the first upper pivot 307 may form a line 313 that may be parallel to a line 314 between the second upper pivot 310 and the second lower pivot 311. A distance from the first lower pivot 309 to the first upper pivot 307 may be equal to a distance from the second upper pivot 310 to the second lower pivot 311. Thus, the first upper pivot 307, the first lower pivot 309, the second upper pivot 310 and the second lower pivot 311 may each form a corner of a parallelogram shape.

As generally shown in FIGS. 4-6, the scraping device 1 may be adjusted to raise or to lower the frame 2 relative to the ground. The frame 2 may be raised and/or lowered by the front lift mechanism 60 and/or the rear lift mechanism 61.

As shown in FIG. 5, the push block 300 may maintain the distance 340 from the adjacent ground despite adjustment of the frame 2 so that the back end 38 of the frame 2 may be closer to the ground. Movement of the back end 38 of the frame 2 to a position closer to the ground may move the central beam 202 in a direction upward relative to the frame 2 and, therefore, may move the first lower pivot 309 in a direction upward relative to the second lower pivot 311. The movement in an upward direction of the central beam 202 and/or movement in an upward direction of the first lower pivot 309 may force the push block 300 in a direction upward relative to the second lower pivot 311. Movement of the push block 300 upward relative to the second lower pivot 311 may move the first upper pivot 307 in a direction upward relative to the second lower pivot 311 and/or the second upper pivot 310.

The upper arm 306 may maintain the distance between the first upper pivot 307 and the second upper pivot 310. The push block 301 may maintain the distance between the first upper pivot 307 and the first lower pivot 309. The support 218 may maintain the distance between the first lower pivot 309 and the second lower pivot 311. The back end 38 of the frame 2 may maintain the distance between the second upper pivot 310 and the second lower pivot 311.

Thus, the first upper pivot 307, the first lower pivot 309, the second upper pivot 310 and the second lower pivot 311 may maintain the parallelogram shape despite the movement in a direction upward of the push block 300 relative to the back end 38 of the frame 2.

Maintaining the parallelogram shape may maintain the distance 340 of the bumper 301 from the ground despite the decrease in the distance 240 of the frame 2 from the ground. The parallelogram shape may provide a level orientation of the push block 300 relative to the ground wherein the distance 440 of the lower pivot 309 from the ground is approximately equal to the distance 340 of the lower surface 330 of the bumper 301 from the ground.

As generally shown in FIG. 6, if the back end 38 of the frame 2 is at a distance farther from the ground, the push block 300 may maintain the distance 340 from the adjacent ground. Movement of the back end 38 of the frame 2 to a position farther from the ground may move the central beam 202 downward relative to the frame 2 and, therefore, may move the first lower pivot 309 in a direction downward relative to the second lower pivot 311. The movement of the central beam 202 in a direction downward and/or the first lower pivot 309 in a direction downward may force the push block 300 in a direction downward relative to the second lower pivot 311. Movement of the push block 300 downward relative to the second lower pivot 311 may move the first upper pivot 307 downward relative to the second lower pivot 311 and/or the second upper pivot 310.

The first upper pivot 307, the first lower pivot 309, the second upper pivot 310 and the second lower pivot 311 may maintain the parallelogram shape if the push block 300 moves in a direction downward relative to the back end 38 of the frame 2. Maintaining the parallelogram shape may maintain the distance 340 of the bumper 301 from the ground if the distance 240 of the frame 2 from the ground is increased. The parallelogram shape may provide level orientation of the push block 300 relative to the ground wherein the distance 440 of the lower pivot 309 from the ground is approximately equal to the distance 340 of the lower surface 330 of the bumper 301 from the ground.

It should be understood that various changes and modifications to the presently preferred embodiments described herein will be apparent to those skilled in the art. Such changes and modifications may be made without departing from the spirit and scope of the present invention and without diminishing its attendant advantages.

I claim:

1. A push block comprising:

an arm having a length defined by a first end and a second end wherein the second end in a position opposite to the first end;

a tire beam having a length defined by a first end beam and a second end wherein the second end is in a position opposite to the first end of the tire beam;

a bumper connected to the arm and the tire beam wherein the bumper has an inner surface and an outer surface wherein the outer surface is in a position opposite to the inner surface;

a first pivot on the arm wherein the first pivot on the arm connects the bumper to the second end of the arm;

a second pivot on the arm wherein the second pivot on the arm is positioned at the first end of the arm;

a first pivot on the tire beam wherein the first pivot on the tire beam connects the bumper to the second end of the tire beam wherein the first pivot on the tire beam is positioned at a distance from the first pivot on the arm;

a second pivot on the tire beam wherein the second pivot on the tire beam is positioned at the first end of the tire beam wherein the second pivot on the tire beam is positioned at a distance from the second pivot on the arm wherein the distance of the second pivot on the tire beam from the second pivot on the arm is equal to the distance of the first pivot on the tire beam from the first pivot on the arm wherein the second pivot on the tire beam is a distance from the first pivot on the tire beam wherein the distance of the second pivot on the tire beam from the first pivot on the tire beam is equal to the length of the arm.

2. The push block of claim 1 further comprising:

a plurality of pins wherein the first pivot on the arm, the first pivot on the tire beam, the second pivot on the arm and the second pivot on the tire beam each have one of the plurality of pins.

3. The push block of claim 1 further comprising:

a support that connects the bumper to the first pivot of the arm and the first pivot of the tire beam wherein the support has an inner surface that is connected to the arm and the tire beam and an outer surface that is attached to the inner surface of the bumper wherein the outer surface is in a position opposite to the inner surface.

4. The push block of claim 1 further comprising:

an upper surface on the bumper and a lower surface on the bumper wherein the lower surface is in a position opposite to the upper surface wherein the upper surface and the lower surface are substantially parallel.

5. The push block of claim 1 further comprising:

a tire connected to the tire beam.

6. The push block of claim 1 further comprising:

a cylinder connected to the tire beam and to a cylinder pivot adjacent to the second pivot of the arm wherein movement of the cylinder moves the tire beam from a first position relative to the cylinder pivot to a second position relative to the cylinder pivot wherein the first position is a different position than the second position.

7. A method for collecting a material from a surface, the method comprising the steps of:

providing a scraping device having a frame having walls defining an interior wherein the frame has a length defined between a front end and a back end wherein the back end is connected to a tire beam at a first lower pivot wherein the tire beam rotates relative to the back end of the frame wherein the back end of the frame is connected to an arm at a first upper pivot wherein the first upper pivot is positioned at a height above the first lower pivot wherein the arm is connected to a push block at a second upper pivot wherein the push block has a bumper wherein the second upper pivot is positioned at a distance from the first upper pivot wherein the push block transmits force from the bumper to the frame wherein the tire beam is connected to the push block at a second lower pivot wherein the second upper pivot is positioned at a height above the second lower pivot wherein the height of the first upper pivot above the first lower pivot is equal to the height of the second upper pivot above the second lower pivot wherein the second lower pivot is positioned at a distance from the first lower pivot wherein the distance of the second lower pivot from the first lower pivot is equal to the distance of the second upper pivot from the first upper pivot;

contacting the push block with another vehicle; and moving the scraping device across the ground surface.

8. The method of claim 7 further comprising the step of:

moving a cylinder attached to the tire beam and to the back end of the frame wherein moving the cylinder adjusts a distance of the back end from the tire beam.

9. The method of claim 7 further comprising the step of:

moving a plate positioned in the interior from the back end to the front end to force the material from the frame.

10. The method of claim 7 further comprising the step of:

raising a lip connected to the front end of the frame and extending above the frame wherein the lip is raised to allow material to be pushed from the frame.

11. The method of claim 7 further comprising the step of:

moving the frame from a first position relative to the tire beam to a second position of the frame relative to the tire beam wherein the second position is a position different from the first position.

12. The method of claim 7 further comprising the step of:

moving the push block from a first position relative to the back end to a second position relative to the back end wherein the second position is a position different from the first position wherein a distance of the push block from the ground surface is the same in the first position and the second position.

13. A scraping device for scraping an area of soil, the scraping device comprising:

a frame having walls defining an interior and further having a length defined between a first end and a second end wherein the second end is in a position opposite to the first end;

a tongue extending from the first end of the frame;

a tire beam connected to the second end of the frame at a first lower pivot wherein the frame is at a first vertical position relative to the tire beam;

a push block connected to the tire beam at a second lower pivot wherein a first distance is defined by the first lower pivot and the second lower pivot wherein the push block has an outer surface wherein the outer surface is located in a position opposite to the first end of the frame;

connecting means attached to the second end of the frame at a first upper pivot wherein the connecting means is attached to the push block at a second upper pivot wherein a second distance is defined by the first upper pivot and the second upper pivot wherein the first distance is equal to the second distance wherein a third distance is defined by the first upper pivot and the first lower pivot wherein a fourth distance is defined by the second upper pivot and the second lower pivot wherein the third distance is equal to the fourth distance.

14. The scraping device of claim 13 further comprising:

a surface on the push block wherein the surface is convex relative to the push block and in a position opposite to the first end of the frame.

15. The scraping device of claim 13 further comprising:

pins that attach the connecting means to the first upper pivot and the second upper pivot.

16. The scraping device of claim 13 further comprising:

a support that connects the tire beam to the first lower pivot wherein rotation of the support relative to the back end of the frame moves the second end of the frame from a first distance from the tire beam to a second distance from the tire beam wherein the second distance is a distance different from the first distance.

17. The scraping device of claim 13 further comprising:

a cylinder connected to the second end of the frame and to the tire beam wherein movement of the cylinder adjusts a distance of the second end of the frame from the tire beam.

18. The scraping device of claim 13 further comprising:

a cylinder connected to the first end of the frame and to the tongue wherein the cylinder moves to adjust a distance of the first end of the frame from the tongue.

19. The scraping device of claim 13 further comprising:

an ejector plate positioned at the back end of the frame wherein moving the ejector plate in a direction toward the front end of the frame pushes material from the frame.

20. The scraping device of claim 13 further comprising:

a lip connected to the front end of the frame and extending above the frame wherein the lip is raised to allow material to be pushed from the frame.

* * * * *